United States Patent [19]

Gresens et al.

[11] Patent Number: 4,826,119

[45] Date of Patent: May 2, 1989

[54] ARTICLE RETAINING FIXTURE WITH SUPPORTING STRUCTURE

[75] Inventors: Stanley T. Gresens, Chicago; John P. Chap, Lemont, both of Ill.

[73] Assignee: Selfix, Inc., Chicago, Ill.

[21] Appl. No.: 139,990

[22] Filed: Dec. 31, 1987

[51] Int. Cl.[4] ..... F16L 3/08

[52] U.S. Cl. ..... 248/223.3; 403/407.1

[58] Field of Search ..... 248/223.3, 223.4, 220.2, 248/224.3, 314, 213.2, 221.3, 225.31, 311.2; 403/407.1, 405.1, 384

[56] References Cited

U.S. PATENT DOCUMENTS

| | | | |
|---|---|---|---|
| 1,625,163 | 4/1927 | Schurr | 248/223.4 X |
| 1,794,700 | 3/1931 | McCaskey | 248/221.3 |
| 2,127,230 | 8/1938 | Moineau | 248/221.3 |
| 2,595,752 | 5/1952 | Batts | 248/224.3 |
| 2,926,879 | 3/1960 | Dietrich | 248/223.4 X |
| 3,596,861 | 8/1971 | Baldini | 248/223.4 |
| 3,848,843 | 11/1974 | Levy | 248/223.4 |
| 4,389,133 | 6/1983 | Oberst | 403/407.1 |
| 4,696,447 | 9/1987 | Strecker | 248/314 X |

*Primary Examiner*—Ramon O. Ramirez

*Attorney, Agent, or Firm*—Dressler, Goldsmith, Shore, Sutker & Milnamow, Ltd.

[57] ABSTRACT

A fixture assembly including a plastic-coated wire fixture module and a universal support mechanism therefor. The support mechanism includes a cap module which is connectable to a support module for readily mounting any of a variety of fixture modules on a flat wall or surface. The cap module includes an outer decorative surface defining an open back cover which fits over and is captively received on the support module. Any of a variety of wire fixture modules may be releasably connected to the cap module such that they extend transversely thereto.

18 Claims, 2 Drawing Sheets

26
12
20
32
32
18
44
16
42
62
60
62
44
10
66
14
41
34
37
38
40
39
36
38
35

16
44
54
46
44
44
62
62
60
52
54
60
62
62
54
48
50
46
48

16
50
48
28
52
46
48
44
44
38
26
38
36
60
54
12
20
30
54
60
36

ARTICLE RETAINING FIXTURE WITH SUPPORTING STRUCTURE

TECHNICAL FIELD

The present invention generally relates to plastic coated wire items and, more particularly, to a unitary assemblage of a plastic coated wire article retaining fixture and supporting structure therefor.

BACKGROUND OF THE INVENTION

Various types and forms of fixtures are adapted for attachment to a wall or similar supporting surface. Examples of such fixtures include towel racks, tissue holders, paper cup holders, soap dishes and various other products. A large number of these fixtures are permanently affixed to the supporting surface through an adhesive or by suitable attachment mechanisms such as screws or nails. Once attached to the surface, however, such appliances may not be conveniently removed and reapplied to the surface.

It is often difficult to estimate exactly where a fixture is to be arranged for optimal ergonomic and aesthetic effect. When such a fixture is not initially affixed to the surface in the desired position or orientation, there exists some degree of dissatisfaction with the fixture or appliance. The known problems of reaffixing the fixture not only detract from the consumers' affection for the product, but often results in reduction in the ability to reapply or reaffix the fixture to the surface. At times, reaffixation attempts result in the destruction of the fixture itself, or of the surface to which it is attached.

Many such fixtures are not themselves affixed directly to the supporting surface. Instead, a fixture assembly is used consisting of at least two components including a support plate or bracket and the fixture supported thereon. With such structure, the support is attached to the supporting surface and is adapted to receive the fixture. The support usually is designed so that when the fixture is attached thereto, it is effectively a unitary structure in which the fixture is rendered immovable relative to the support.

Plastic-coated metal wire devices have become very popular consumer items. These types of devices or goods are available in a wide variety of configurations including shelves, racks, baskets, and like arrangements which facilitate convenient storage of articles where desired. These types of devices typically include interconnected coated wire members which are configured to define any of a plurality of different designs. The preferred plastic coating on these types of goods provides an attractive, durable, corrosion-resistant finish which permits these types of goods to be used in kitchen and bathroom areas, as well as throughout all parts of the home. Moreover, the vinyl or plastic coating is available in a variety of colors for pleasing appearance, and provides a resilient surface suitable for engaging porcelain, formica, metal, and other household surfaces without scratching or marring.

There are occasions where it may be desirable to alter or change the fixtures in a room such that it blends with or is compatible with changing decor of the room or space in which it is located. There are also occasions when the fixture itself is to be changed and it would be desirable to provide a different fixture design without having to change costly supporting structure therefor.

Heretofore, no known fixture assembly combines the desirable features of coated wire products with a modular support structure that would permit the desired orientation of a wire fixture structure relative to the support surface or wall. Moreover, no known fixture assembly combines the desirable features of coated wire products with a modular support structure which permits a particularly configured wire structure to be readily interchanged with other wire structures of a different shape, color, or design.

SUMMARY OF THE INVENTION

In view of the above, and in accordance with the present invention, there is provided a plasticcoated wire fixture assembly which is modular in nature. In general, the fixture assembly of the present invention comprises a plastic-coated wire fixture module and a support mechanism. The support mechanism includes a cap module which is connectable to a support module for readily mounting any of a variety of fixture modules on a flat wall or surface. Each module in the assembly is inexpensive to manufacture, interchangeable, and may be produced in a variety of colors adapted to a myriad of environments and consumers' personal tastes.

The fixture module comprises a plastic-coated wire frame structure for ease of economical fabrication, and for convenient, durable, and attractive use. In its preferred form, the fixture module includes two vertically spaced wire members having substantially similar configurations. These wire members are joined by a plurality of spaced, vertical interconnecting members.

Preferably, a common or universal support mechanism is used to attach the fixture module to the wall. As such, interchangeability between fixture module designs is readily and easily accomplished. The support mechanism of the present invention includes a support module and a cap module with both modules having coacting connecting members.

In its preferred form, the support module includes a support member which is substantially similar to that disclosed in U.S. Pat. No. 3,848,843. The support member is adapted to be permanently or semi-permanently affixed to a wall or other supporting surface. Moreover, the support member typically is molded of a suitable plastic material and has an adhesive applied to a rear surface thereof allowing the support member to be affixed to the wall or supporting surface. Alternatively, the support member may be attached to the wall by screws or other mechanical devices.

A cap connecting portion is provided on the support member forward of the rear surface thereof. The cap connecting portion typically is universally shaped, for example, having a generally circular peripheral shape. In one embodiment of the present invention, a support member is provided having a generally circular rear or back surface for connecting the support member to a flat surface or wall and a connecting portion in the form of a generally annular flange arranged forward of the rear surface. The annular flange includes a plurality of uniformly spaced radially extending serrations or grooves which may, conveniently, extend around an entire front surface of the annular flange. These radial grooves or serrations define interlocking elements on the annular flange.

The cap module typically is molded of a suitable plastic material and defines an open back cover which fits over the support member and has an outer decorative surface. The cover or cap includes a front surface with side surfaces joined to and extending therefrom.

On a rear interior surface, the cap is provided with at least one tooth like member which defines another interlocking element. The cap is also provided with a plurality of inwardly extending fingers or tabs. These tabs coact with the flange on the support member and allow the cap member to be slidably and captively accommodated on the support member. The cap module further includes outwardly extending flexible plastic tabs or fingers provided on opposed sides of the cap.

In its assembled state, a desired color and form of fixture module may be combined with a desired color and form of cap module. The wire members of the fixture module pass through and are connected along opposite side surfaces of the cap module. In one embodiment, the outwardly extending tabs on the cap combine flexibility and resiliency in coacting with the spaced vertical interconnecting members of the wire structure to removably connect the fixture module to the cap module.

The cap and fixture modules may be mounted as a unitary assemblage to the support module which may already be attached to a wall. To effect these ends, the cap module is vertically moved to slide over the support module. Through such action, the inwardly extending members or tabs on the cap fit over and coact with the stationary flanged portion of the support member. By such construction, the cover or cap with the fixture module affixed thereto may be vertically moved but transverse movement between the cap and the support module is inhibited.

When the cap is slidably positioned over the support member, the interlocking element on the cap becomes wedged into the serrations on the flange. This interlocking relationship maintains the cap and fixture modules stationary on the support member.

Other features and advantages of the present invention will become readily apparent from the following detailed description, the appended drawings, and the accompanying claims.

DETAILED DESCRIPTION OF THE PREFERRED EMBODIMENT

Figure 1:
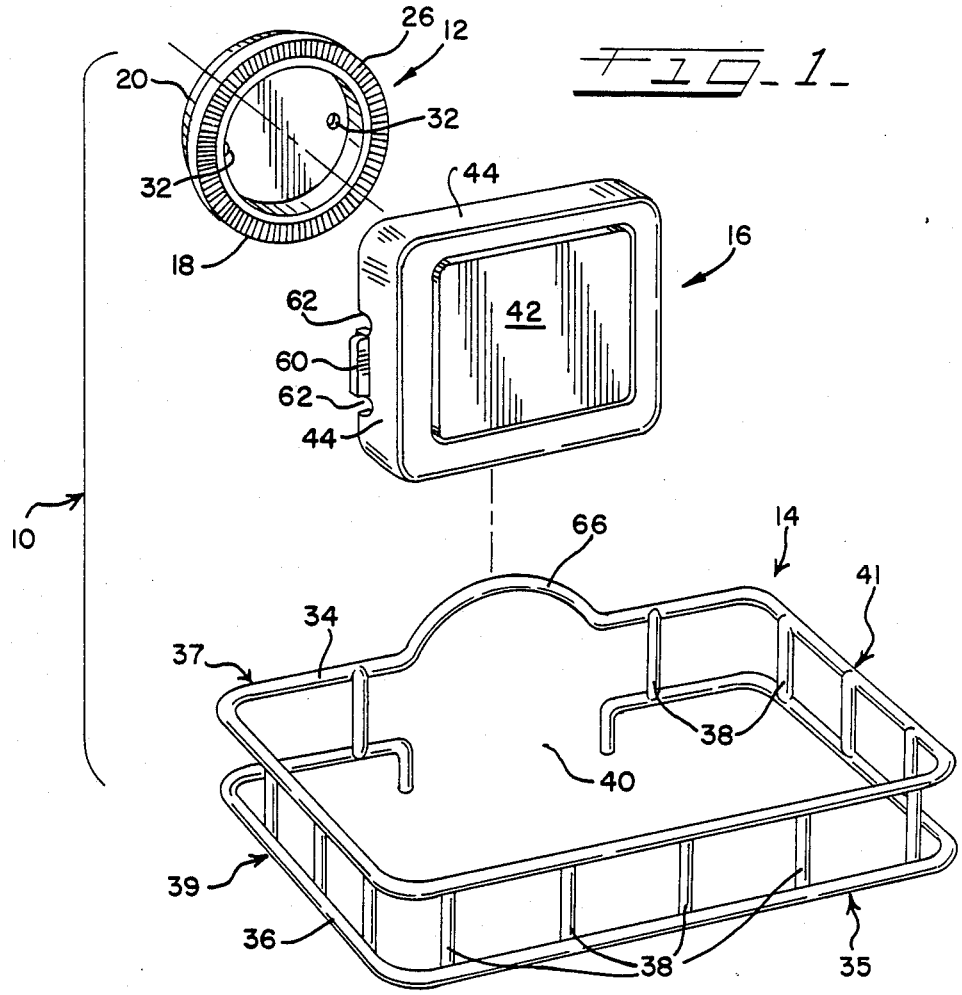
FIG. 1 is an exploded perspective view illustrating component parts of one embodiment of the present invention.

While the present invention is susceptible of embodiment in various forms, there is shown in the drawings as will hereinafter be described the presently preferred embodiment, with the understanding that the present disclosure is to be considered as an exemplification of the invention, and is not intended to limit the invention to the specific embodiment illustrated.

Referring now to the drawings, wherein like reference numerals indicate like parts throughout the several views, there is shown a fixture assembly 10 including a support module 12, a fixture module 14 and a cap or cover module 16. The fixture assembly shown in the drawings is illustrated as having a single support for a bathroom fixture, i.e. a towel ring, but it will be appreciated that a myriad of other types of fixtures employing one or more support and cap modules may be used without departing from the spirit and scope of the invention.

Figure 7:
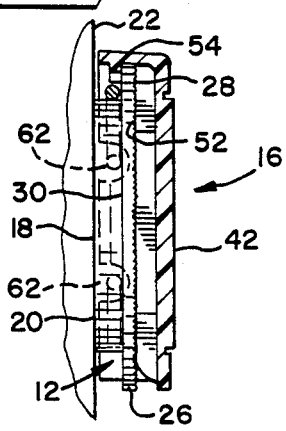
FIG. 7 is a sectional view taken along line 7—7 of FIG. 3.

The support module 12 may be of the type as shown in U.S. Pat. No. 3,848,843 and sold by applicant's assignee under the trademark Magic Circle. The support module 12 includes a body 18 which is molded from suitable plastic material. Module 12 has a rear or attachment portion 20 for affixing the support member to a wall or other supporting surface 22 (FIG. 7). The rear portion 20 of the body incorporates a fibrous or wood insert 24 (FIG. 5) having a suitable adhesive on the exposed surface thereof. As illustrated, the support member 12 is of a generally circular configuration and includes an outwardly extending annular flange 26 forwardly spaced from the rear portion 20 of the support member. The flange portion 26 of the supporting member is provided with front and rear planar flange surfaces 28 and 30, respectively. The support member may be further provided with partial apertures 32 through which mechanical attachment devices such as screws or nails may be passed for attaching the support member or module 26 to a surface as an alternative to the adhesive on the exposed back surface of the wood insert.

As explained in detail in U.S. Pat. No. 3,848,843, the front planar surface 28 of the annular support flange incorporates a plurality of radially extending deformations in the form of serrations, grooves or teeth, typically extending around the entire surface thereof. The radial deformations define interlocking elements on the support module. As will be subsequently described, the serrations or deformations are adapted to retain the fixture module in desired orientation when supported on the support module.

It should be appreciated that alternative forms of support members may be provided without departing from the spirit and scope of the invention. As an example, a square flanged support member could be used for the fixture assembly in lieu of the circular design.

Fixture module 14 preferably comprises one or more rigidly formed, plastic-coated metal wire members which are appropriately shaped to provide the fixture with its desired configuration. The plastic coating may comprise vinyl or like material which is suitably durable and corrosion-resistant, and which is typically available in a wide variety of colors for enhancing the aesthetic appeal of the fixture. The fixture 14 may be fabricated in accordance with known methods, typically comprising suitable interconnection of the various members of the fixture such as by welding, with the entire arrangement thereafter plastic coated.

As illustrated, fixture module 14 includes two vertically spaced members designated 34 and 36. In its illustrated form, members 34 and 36 are configured to provide a fixture module which, when connected to cap module 16, extends transverse from the wall or support surface 22 and defines a front section 35, a back section 37 and two opposed side sections 39 and 41. Members 34 and 36 are joined by a plurality of spaced vertical interconnecting wire elements 38. As illustrated, and as will be subsequently discussed, upper wire member 34 is formed as a closed loop while the other or lower wire member 36 has downwardly extending, laterally spaced apart opposed end portions 36a, 36b defining an opening 40 in the lower loop or member 36. The lateral spacing between the ends defining opening 40 proximates the diameter of the rear portion 20 of the support module 12.

Figure 8:
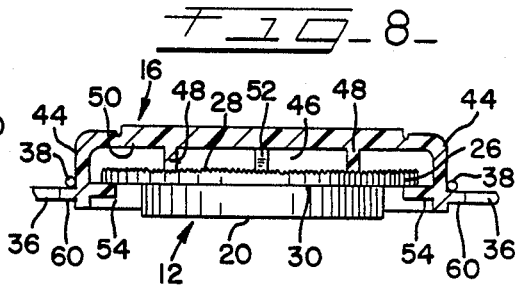
FIG. 8 is a sectional view taken along line 8—8 of FIG. 5.
Figure 6:
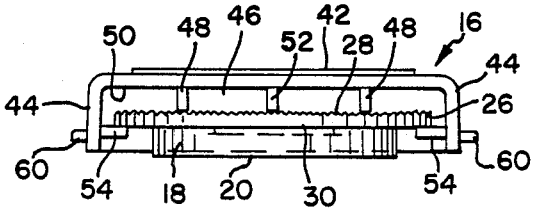
FIG. 6 is a bottom view of the mounting arrangement illustrated in FIG. 4.

The cap module 16 is typically molded from a suitable plastic material and defines an open back cover having an outer decorative surface including front and side surfaces 42 and 44, respectively. More specifically, and as seen in FIGS. 6 and 8, the side surfaces 44 transversely extend rearwardly from the front surface 42 to define a recess 46 sufficiently sized to fit over the support module 12. A plurality of laterally spaced ribs 48 may transversly project from a back surface 50 of the cap module 16 and are adapted to abut against the front planar surface 28 of the support module 12. A central deformation 52 also provided on the inner surface 50 is adapted to coact with the deformations on the front planar surface 28 of flange. That is, the deformation 52 defines a tooth or bead which is adapted to coact or interlock with the deformations on the front planar surface 28 of flange. Because of its central location, the tooth 52 becomes wedged with the deformations on the flange in a manner interconnecting the cover or cap module 16 with the support member 12.

Figure 2:
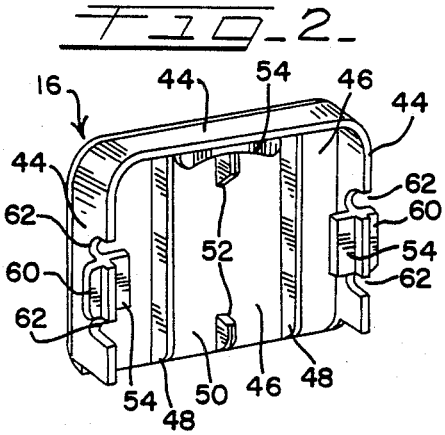
FIG. 2 is a rear perspective view of a cap module of the present invention.

The cap module 16 is interconnected with the support module 12 in a manner allowing vertical movement while preventing transverse movement therebetween. As seen in FIGS. 2, 6, and 8, cover or cap module 16 is provided with a plurality of tabs 54 which are formed as an integral part of the cover 16. The tabs 54 are angularly and evenly spaced about the cover 16 and extend generally perpendicular to the side surfaces 42 into the recess 46. The tabs 54 are adapted to coact with the rear planar surface 30 of the annular flange portion 26 of module 12. That is, the flange portion 26 is adapted to snugly fit, in a captive relationship, between tabs 54 and the upstruck ribs 48.

Figure 3:
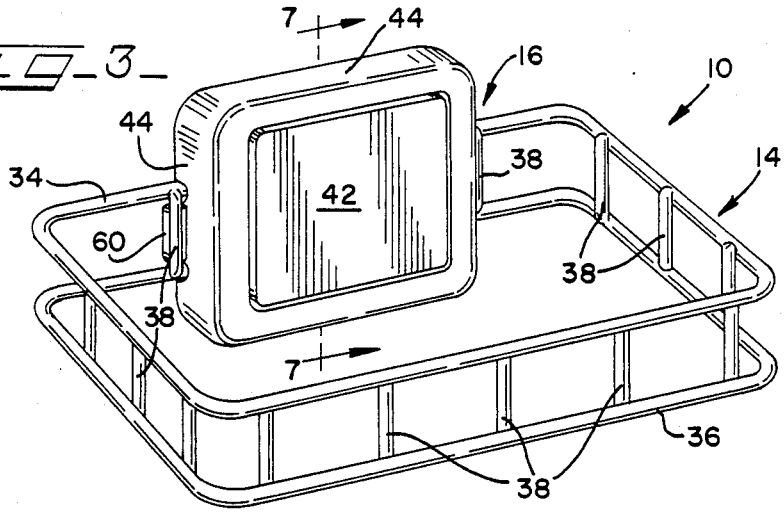
FIG. 3 is an assembled perspective view of the present invention.
Figure 5:
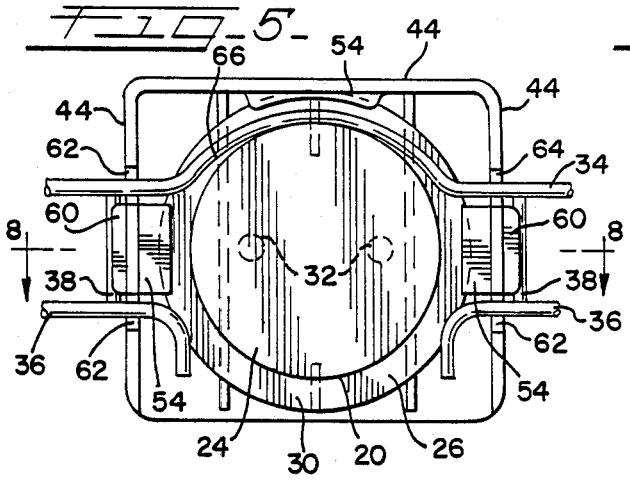
FIG. 5 is a rear elevational view of the mounting arrangement illustrated in FIG. 4.
Figure 4:
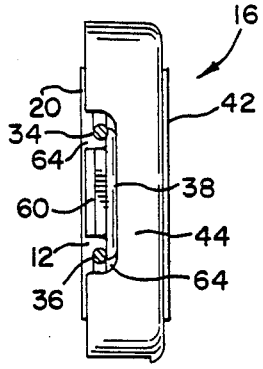
FIG. 4 is an end view of a mounting arrangement embodying the principles of the present invention.

Cap module 16 is also interconnected with the fixture module 14 in a manner which allows the cap module 16 and fixture module 14 to form a unitary assemblage which may be subsequently mounted on the support member. To effect these ends, the cap module 16 is provided with tabs or fingers 60 which allow the fixture 14 to be connected along opposed side surfaces of the cover 16. The tabs 60 extend generally perpendicular to and outwardly from two opposed side surfaces 44 on the cover module 16. As seen in FIGS. 3, 5, and 8, tabs 60 are adapted to coact with two interconnecting members 38 on the fixture. To effect these ends, at least two of the vertically spaced connecting members 38 of the wire frame module 14 are spaced apart a distance substantially equal to a distance that the opposed sides of the cap 16 are laterally spaced apart. Because the cap 16 is formed of a plastic like material, the tabs 60 are provided with a certain degree of resiliency permitting the fixture module 14 to be readily connected/disconnected to the cover while retaining sufficient holding power to keep the fixture module 14 securely in place without movement.

Moreover, the opposed side surfaces of the cap 16, along which the frame or fixture is connected, includes a plurality of slots 62. The slots in the side surfaces of the cap allow the wire members 34, 36 of the fixture module 14 to pass therethrough.

In assembling the fixture assembly, the wire frame module may be releasably connected to the cover by means of tabs 60 coacting with the vertically spaced members 38. It will be understood, of course, that a frame structure having a single wire with vertically depending arms similar to the interconnecting members may be used in lieu of a double wire structure. Other alternative forms of frame module connection means could be provided in lieu of that which is disclosed. In one form, apertures could be provided in the opposed side surfaces of the cap module. Such apertures could receive and hold free ends of the wire members defining the fixture module 14.

As a unitary assemblage, the cover module 16 and fixture module 14 may be mounted to the support module 12 which has been previously affixed to a surface 22. To effect these ends, the cover module 16 is vertically slid over the flange portion 26 of the mounting module 12. As illustrated, the opening 40 in the lowermost member 36 of the wire frame allows the cap module 16 and fixture module 14 to be vertically displaced over the support module 12. As such, the flange 26 captively retains the cover module 16 thereon through the cooperating action of the tabs 54 and flange 26.

As seen in FIG. 5, the closed loop member 34 of the fixture module comprises an arcuate portion 66 which is adapted to fit around the support module 12. As seen in FIG. 7, arcuate portion 66 of the closed wire loop 34 passes behind the rear face 30 of flange 26 of the support module 12 in a manner adding rigidity to the transversely extending frame module 14. Likewise, the opposed ends of the lowermost wire member 36 are adapted to coact with the rear face 30 of the flange 26 to provide the proper disposition of the fixture module.

Since the annular flange 26 of the mounting module 12 is completely symetrical, the positions or orientations of the support module on the surface or wall 22 is not determinative of the orientation of the fixture module and cover module 16. That is, the cover and fixture assembly can be connected as a unitary assemblage to and supported on the support module in any position of the support module 12. It will be understood that the tooth 52 engaging the serrations on the front face 28 of the flange 26 will retain the fixture module 14 in any desired position. Since the initial orientation of the support module 12 is not determinative of the fixture module orientation, ultimately customer satisfaction is increased due to ease of assembly.

Thus, there has been a disclosed a decorative fixture assembly which can be manufactured in a variety of dimensions, shapes, and in an inexpensive manner. Because the component parts of the assemblage are inexpensive to manufacture, any of a variety of various shapes may be interchanged with others without significantly adding to the cost of the entire assemblage. That is, because of the modular nature of the device, interchangeability between parts is achievable at relatively inexpensive costs to the consumer.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed:

1. An article retaining fixture assembly adapted to be attached to a flat surface comprising:

a rigidly formed, plastic-coated wire framework structure defining an article retaining fixture;

a support member adapted to be affixed to the flat surface;

a cap having an outer decorative surface which fits over said support member, said cap further including means for releasably connecting said wire framework structure thereto such that said framework structure transversely extends away from said flat surface; and coacting connecting members, respectively, on said support member and said cap for permitting said cap with said wire framework structure connected thereto to be releasably connected as a unitary assemblage to said support member.

2. The article retaining fixture assembly of claim 1 wherein said support member includes a plastic body and an attachment member bonded to a rear portion of said body for affixing said support member to the flat surface.

3. The article retaining fixture assembly of claim 2 wherein the connecting member on said support member comprises a flange portion arranged on said body forward of said rear portion, said flange portion having front and rear planar flange surfaces.

4. The article retaining fixture assembly of claim 3 wherein the connecting member on said cap comprises a plurality of inwardly extending and angularly spaced tabs adapted to coast with the rear planar surface of said flange.

5. The article retaining fixture assembly of claim 1 wherein said means for connecting said wire framework structure to said cap includes outwardly extending tabs formed integral with opposed side surfaces on said cap, said tabs being adapted to interact with two of said spaced vertical interconnecting elements on said framework structure.

6. The article retaining fixture assembly of claim 1 wherein said support member and said cap further include interlocking elements having a configuration for locking said cap with said wire structure connected thereto and said support member in selected orientation relative each other and to preclude relative angular movement between said cap and support member.

7. An article retaining fixture assembly adapted to be attached to a flat surface comprising:

a support member adapted to be affixed to the support surface along a rear planar surface of said member, said support member further including a flange arranged forward of said planar surface;

an open back cap extending over said support member and defining an outer decorative surface including front and side surfaces, said cap further including means for releasably interconnecting said cap with said flange in a manner allowing relative vertical movement while preventing transverse movement therebetwen; and a rigidly formed, plastic-coated wire frame structure connected to said cap along the side surfaces thereof and transversely extending away from said flat surface to define an article retaining fixture;

said cap and said frame structure being engageable with said support member for releasably retaining said cap and said frame structure on said support attached to the flat surface.

8. The article retaining fixture assembly of claim 8 wherein said flange on said support member is in the form of a generally annular flange having front and rear generally planar surfaces.

9. The article retaining fixture assembly of claim 8 wherein the front planar surface of said flange and a back surface on said cap include interlocking elements engagable with each other to preclude relative angular movement between said cap and said support member.

10. The article retaining fixture assembly of claim 3, wherein said wire framework structure includes at least one wire member passing through opposed sides of said cap and forming a closed loop.

11. The article retaining fixture assembly of claim 10 wherein said closed loop member passes behind said rear planar flange surface of said supporting member.

12. An article retaining fixture assembly adapted to be attached to a flat surface comprising:

a support member adapted to be affixed to the support surface along a rear planar surface of said member, said support member further including a flange arranged forward of said planar surface;

an open back cap extending over said support member and defining an outer decorative surface including front and side surfaces, said cap further including means for releasably interconnecting said cap with said flange in a manner allowing relative vertical movement while preventing transverse movement therebetwen; and a rigidly formed, plastic-coated wire frame structure connected to said cap along the side surfaces thereof and transversely extending away from said flat surface to define an article retaining fixture;

said wire frame structure including at least two vertically spaced wire members passing through opposed side surfaces of said cap and joined by a plurality of spaced, vertical connecting members.

13. The article retaining fixture assembly of claim 12 wherein said means for releasably interconnecting said cap with said flange comprises a plurality of angular spaced tabs extending inwardly from the side surfaces of said cap to coact with the rear planar surace of said flange.

14. The article retaining fixture assembly of claim 13 wherein said cap further includes a resilient connection member laterally extending from each of said opposed sides of said cap, each of said resilient connection members being adapted to interact with vertically spaced connection members on said wire structure frame in a manner connecting said wire structure frame to said cap.

15. The article retaining fixture assembly of claim 14 wherein at least two of said vertically spaced connecting members on said wire frame structure are spaced apart a distance substantially equal to a distance said opposed sides of said cap are laterally spaced apart.

16. An article retaining fixture assembly adapted to be attached to a flat surface comprising:

a rigidly formed, plastic-coated wire framework structure defining an article retaining fixture;

a support member adapted to be affixed to the flat surface;

a cap having an outer decorative surface which fits over said support member, said cap further including means for releasably connecting said wire framework structure thereto such that said framework structure transversely extends away from said flat surface; and coacting connecting members, respectively, on said support member and said cap for permitting said cap with said wire framework structure connected thereto to be releasably connected as a unitary assemblage to said support member;

said wire framework structure including at least two vertically spaced wire members passing through opposed sides of said cap and joined by a plurality of spaced vertical interconnecting wire elements.

17. The article retaining fixture assembly of claim 16 wherein one of said wire members is formed as a closed loop while the other wire member has opposed ends which terminate inside the outer decorative surface of said cap.

18. An article retaining fixture assembly adapted to be attached to a flat surface comprising:

a support member adapted to be affixed to the support surface along a rear planar surface of said member, said support member further including a generally annular flange arranged forward of said planar surface, said flange having front and rear generally planar surfaces;

an open back cap extending over said support member and defining an outer decorative surface including front and side surfaces, said cap further including means for releasably interconnecting said cap with said flange in a manner allowing relative vertical movement while preventing transverse movement therebetwen; and a rigidly formed, plastic-coated wire frame structure connected to said cap along the side surfaces thereof and transversely extending away from said flat surface to define an article retaining fixture;

said wire frame structure including one closed loop configured wire passing through opposed side surfaces of said cap and behind the rear planar surface of said flange, and a second wire arranged vertically beneath and having substantially the same configuration as said closed loop wire, said second wire being joined to the closed loop wire by a plurality of vertical connecting members, and further having opposed ends which pass through said opposed side surfaces of said cap and terminate inwardly thereof.

* * * * *

UNITED STATES PATENT AND TRADEMARK OFFICE

CERTIFICATE OF CORRECTION

PATENT NO. : 4,826,119

DATED : May 2, 1989

INVENTOR(S) : Stanley T. Gresens; John P. Chap

It is certified that error appears in the above-identified patent and that said Letters Patent is hereby corrected as shown below:

Column 7, line 34 (Claim 5, line 1) - Change "1" to --16--.

Column 8, line 1 (Claim 8, line 1) - Change "8" to --7--.

Signed and Sealed this

Ninth Day of January, 1990

*Attest:*

JEFFREY M. SAMUELS

*Attesting Officer*

*Acting Commissioner of Patents and Trademarks*